US007981202B2

(12) United States Patent
Kojima et al.

(10) Patent No.: US 7,981,202 B2
(45) Date of Patent: Jul. 19, 2011

(54) ELECTROLESS PURE PALLADIUM PLATING SOLUTION

(75) Inventors: Kazuhiro Kojima, Saitama (JP); Hideto Watanabe, Saitama (JP)

(73) Assignee: Kojima Chemicals Co., Ltd., Sayama-shi (JP)

( * ) Notice: Subject to any disclaimer, the term of this patent is extended or adjusted under 35 U.S.C. 154(b) by 0 days.

(21) Appl. No.: 12/085,930

(22) PCT Filed: Feb. 28, 2007

(86) PCT No.: PCT/JP2007/054370

§ 371 (c)(1), (2), (4) Date: Jan. 22, 2009

(87) PCT Pub. No.: WO2008/105104

PCT Pub. Date: Sep. 4, 2008

(65) Prior Publication Data

US 2010/0199882 A1 Aug. 12, 2010

(51) Int. Cl.
*C23C 18/44* (2006.01)

(52) U.S. Cl. ..... 106/1.24; 106/1.28

(58) Field of Classification Search ..... 106/1.24, 106/1.28

See application file for complete search history.

(56) References Cited

U.S. PATENT DOCUMENTS 4,804,410 A * 2/1989 Haga et al. ..... 106/1.28
5,882,736 A * 3/1999 Stein et al. ..... 106/1.24
6,235,093 B1 * 5/2001 Okuhama et al. ..... 106/1.28
7,632,343 B2 * 12/2009 Kojima et al. ..... 106/1.24
7,704,307 B2 * 4/2010 Aiba et al. ..... 106/1.24

FOREIGN PATENT DOCUMENTS

| | | | |
|---|---|---|---|
| JP | 46-26764 | | 8/1971 |
| JP | 62-124280 | | 6/1987 |
| JP | 8-20887 | A | 1/1996 |
| JP | 8-269727 | A | 10/1996 |
| JP | 10-168578 | A | 6/1998 |
| JP | 10-511738 | A | 11/1998 |
| JP | 11-269658 | A | 10/1999 |
| JP | 2000-26977 | A | 1/2000 |
| JP | 3035763 | | 4/2000 |
| JP | 2000-129454 | A | 5/2000 |

OTHER PUBLICATIONS

International Search Report issued in corresponding International Application No. PCT/JP2007/054370, Jun. 2007.

* cited by examiner

*Primary Examiner* — Helene Klemanski
(74) *Attorney, Agent, or Firm* — Venable LLP; Michael A. Sartori; Michael E. Nelson

(57) ABSTRACT

An electroless pure palladium plating solution capable of forming pure palladium plating films having less plating film variations is provided. The electroless pure palladium plating solution comprises an aqueous solution containing (a) 0.001 to 0.5 mol/liter of a water-soluble palladium compound, (b) 0.005 to 10 mol/liter of at least two members selected from the group consisting of aliphatic carboxylic acids and water-soluble salts thereof, (c) 0.005 to 10 mol/liter of phosphoric acid and/or a phosphate, and (d) 0.005 to 10 mol/liter of sulfuric acid and/or a sulfate.

4 Claims, No Drawings

ELECTROLESS PURE PALLADIUM PLATING SOLUTION

TECHNICAL FIELD

The present invention relates to an electroless pure palladium plating solution. More particularly, it relates to an electroless pure palladium plating solution capable of forming pure palladium plating films having less variations in plating film.

BACKGROUND ART

In electronic parts which are required to have high density and high reliability, as surface treatment of electronic parts which require wire-bonding mounting or soldering mounting, surface treatment with a noble metal having corrosion resistance and excellent electric characteristics is believed to be effective, in particular, gold film plating has played a center role.

However, gold is a material having scarcity value, and thus its price is likely to rise steeply depending upon market quotations. Accordingly, technical development of an alternative metal has attracted attention.

In particular, palladium is inexpensive as compared with gold metal and has been in the spotlight as an alternative metal to reduce a film thickness of a gold plating film.

However, in highly reliable electronic parts in which not only increase of its price but also increase of wiring density have been accelerated in recent years, characteristics, stability and reliability of a palladium plating film have attracted attention.

As an electroless palladium plating solution has heretofore been used in industrial applications, there has been known an electroless palladium plating solution comprising a water-soluble palladium salt, ethylenedianimetetraacetic acid, ethylenediamine, and sodium hypophosphite, as described, for example, in Patent Document 1.

There has also been known an electroless palladium plating solution containing, as essential components, at least one member selected from the group consisting of a palladium compound, ammonia and an amine compound, an organic compound having divalent sulfur, and at least one member selected from the group consisting of a hypophosphorous acid compound and a boron hydride compound (see, for example, Patent Document 2). From these electroless palladium plating solutions, a palladium-phosphorous alloy plating film is obtained.

Besides, there has been known an electroless palladium plating solution containing at least one member selected from the group consisting of a palladium compound, ammonia and an amine compound, and at least one member selected from the group consisting of formic acid, sodium formate and potassium formate (see, for example, Patent Document 3).

The above-mentioned electroless palladium plating solution in Patent Document 1 has not only a drawback of poor storage stability but also a drawback that it is degraded in a short time in an industrial mass production line and thus has a short duration of life as a plating solution. Further, any of plating films obtained from the plating solution are crack-prone and poor in wire-bonding properties and soldering properties, and accordingly, has a difficulty in application to electronic parts.

Moreover, the electroless palladium plating solution disclosed in Patent Document 2 has a drawback that since phosphorus and/or boron derived from the hypophosphorous acid compound and/or the boron compound as a reductive component is contained in a plating film, properties of the palladium plating film markedly change between before and after a heat test.

Furthermore, although the electroless palladium plating solution in Patent Document 3 has excellent storage properties and properties of a palladium plating film are stable and show no substantial difference between before and after a heat test, the plating solution has a technical problem that variations in plating film thickness become considerable as a time period for which the plating solution has been used becomes longer, and thus film thickness control is difficult.

Patent Document 1: Japanese Patent Publication No. Sho46(1971)-026764

Patent Document 2: Japanese Laid-Open Patent Publication No. Sho62(1987)-124280

Patent Document 3: Japanese Patent No. 3035763

DISCLOSURE OF INVENTION

Problem to be Solved by the Invention

It is an object of the present invention to provide an electroless pure palladium plating solution which is practicable in an industrial mass production line and which is capable of forming a stable pure palladium plating film on wirings of highly reliable finely interconnected electronic parts.

Means to Solve the Problem

The present invention resides in an electroless pure palladium plating solution comprising:

an aqueous solution containing (a) 0.001 to 0.5 mol/liter of a water-soluble palladium compound, (b) 0.005 to 10 mol/liter of at least two members selected from the group consisting of aliphatic carboxylic acids and water-soluble salts thereof, (c) 0.005 to 10 mol/liter of phosphoric acid and/or a phosphate, and (d) 0.005 to 10 mol/liter of sulfuric acid and/or a sulfate.

Further, the present invention resides in the electroless pure palladium plating solution wherein the above-mentioned (b) at least two members selected from the group consisting of aliphatic carboxylic acids and water-soluble salts thereof are selected from the group consisting of formic acid or a formate, an aliphatic dicarboxylic acid, an aliphatic polycarboxylic acid and an aliphatic (hydr)oxycarboxylic acid.

In the following, the electroless pure palladium plating solution of the present invention will be described in detail.

As the water-soluble palladium compound used in the present invention, there may be mentioned, for example, palladium chloride, sodium palladium chloride, potassium palladium chloride, palladium ammonium chloride, palladium sulfate, or palladium acetate. The above-mentioned electroless (pure) palladium plating solution preferably has a palladium concentration in a range of 0.0001 to 0.5 mol/liter. If the palladium concentration is lower than 0.0001 mol/liter, plating film deposition rate is undesirably low. On the other hand, if the palladium concentration is higher than 0.5 mol/liter, substantially no further improvement in deposition rate is obtained. This is not practically advantageous. In the plating solution of the present invention, at least one member selected from the group consisting of ammonia and an amine compound in order to maintain stability of the solution. Each of ammonia and the amine compound forms a complex together with palladium contained in the plating solution to exhibit a function of stably keeping these components in the solution, thereby contributing to stabilization of the solution.

A concentration of ammonia and(/or) the amine compound is 0.0005 to 8 mol/liter, preferably 0.01 to 5 mol/liter or higher. When ammonia is used alone, the concentration is more preferably 0.05 to 1 mol/liter with a view to improving stability of the plating solution.

When the concentration of ammonia and(/or) the amine compound is higher, stability of the plating solution is more improved. However, if the concentration is in excess of the above-mentioned range, this is economically disadvantageous. In particular, in the case where ammonia is used, working environment is undesirably deteriorated by an offensive smell or the like. On the other hand, the concentration is lower than the above-mentioned range, stability of the plating solution is lowered and the palladium complex is undesirably liable to decompose.

As the above-mentioned amine compound used in the present invention, there may be mentioned, for example, monoamines such as methylamine, ethylamine, propylamine, trimethylamine and dimethylethylamine; diamines such as methylenediamine, ethylenediamine, tetramethylenediamine and hexamethylenediamine; polyamine s such as diethylenetriamine and pentaethylenehexamine; and other amino acids such as ethylenediaminetetraacetic acid and a sodium salt, potassium salt and ammonium salt thereof, and nitrilotriacetic acid and a sodium salt, potassium salt and ammonium salt thereof, glycine (aminoacetic acid), and iminodiacetic acid.

In the present invention, at least one member selected from the group consisting of ammonia and the amine compound is used. In other words, ammonia and the amine compound may be used alone or in combination. However, when ammonia is used alone, a period of time before initiation of deposition of a plating film can be long. In this case, the time period can be reduced by adding the amine compound as an oxidizing agent. In the plating solution to which the amine compound is added, when a plating film is deposited in a large thickness, the resulting plating film has a particularly good appearance.

Next, as the aliphatic carboxylic acid and the water-soluble salt thereof which are used in the present invention, there may be mentioned, aliphatic monocarboxylic acids such as formic acid, acetic acid, propionic acid, butyric acid, isobutyric acid, valeric acid, and caproic acid; aliphatic polycarboxylic acids such as oxalic acid, malonic acid, maleic acid, succinic acid, and glutaric acid, aliphatic (hydr)oxycarboxylic acid such as malic acid, citric acid, gluconic acid, tartaric acid, glycolic acid, and lactic acid; and a sodium salt, potassium salt and ammonium salt of these carboxylic acids.

In the present invention, it is preferred to use two or more of the above-mentioned aliphatic carboxylic acids in combination. Specifically, the aliphatic monocarboxylic acid such as formic acid, and the aliphatic (hydr)oxycarboxylic acid such as malic acid, citric acid, gluconic acid, tartaric acid, glycolic acid or lactic acid are preferably used in combination.

The plating solution has an aliphatic carboxylic acid concentration of 0.005 to 5 mol/liter, preferably 0.01 to 1 mol/liter.

If the concentration is lower than 0.005 mol/liter, a plating film is not formed sufficiently. On the other hand, if the concentration is higher than 5 mol/liter, deposition rate plateaus and no longer further increases. This is not practically advantageous.

In the present invention, the plating solution has a pH of 3 to 10, and a pH of 5 to 8 is particularly preferred. If the pH is too low, stability of the plating bath is undesirably lowered. If the pH is too high, the resulting plating film is undesirably likely to have cracks. In the present invention, to improve pH buffer function, at least two members selected from the group consisting of phosphoric acid and a phosphate, and sulfuric acid and a sulfate are used. As phosphoric acid and the phosphate, there may be mentioned, for example, orthophosphoric acid, metaphosphoric acid, pyrophosphoric acid, polyphosphoric acids, hypophosphorous acid and phosphorous acid, and salts thereof, and disodium hydrogenphosphate.

As the sulfate, for example, sodium sulfate, potassium sulfate, ammonium sulfate, sodium hydrogensulfate, potassium hydrogensulfate and ammonium hydrogensulfate may be mentioned.

The concentration of phosphoric acid and the phosphate is preferably 0.005 to 1 mol/liter, and the concentration of sulfuric acid and the sulfate is preferably 0.005 to 1 mol/liter.

The plating solution of the present invention is capable of effecting plating at a temperature in a range as broad as 20 to 90 ° C., in particular, it enables an excellent plating film which is smooth and lustrous to be obtained at a solution temperature of 40 to 80° C. Further, when the solution temperature is higher, deposition rate of a plating film tends to be higher. Accordingly, a desired deposition rate can be obtained by appropriately setting the solution temperature within the above-mentioned temperature range. Moreover, in the plating solution of the present invention, the deposition rate of a plating film is dependent on the palladium concentration as well as the temperature of the plating solution. Accordingly, the deposition rate of a plating film can also be controlled by appropriately setting the palladium concentration. This facilitates control of the plating film thickness.

It suffices for forming a plating film by means of the plating solution of the present invention to soak a substrate catalytic to reductive deposition of a palladium film in the plating solution in the above-mentioned temperature range. (A plating film can be formed by means of the plating solution of the present invention by soaking a substrate catalytic to reductive deposition of a palladium film in the plating solution in the above-mentioned temperature range. As the above-mentioned catalytic substrate, there may be mentioned, for example, iron, nickel, cobalt, gold, silver, copper, platinum, palladium and an alloy thereof.

Even a non-catalytic substrate such as a resin substrate, glass substrate or ceramic substrate may be soaked in the plating solution to form a plating film in the same manner as in the above-mentioned method, if catalytic properties have been imparted to the non-catalytic substrate by a known method such as sensitizing-activator method.

The deposition of a palladium film by means of the electroless palladium plating solution of the present invention proceeds autocatalytically. In consequence, the plating film which has low porosity and is dense and excellent in bonding properties can be obtained.

Effect of the Invention

The electroless palladium plating solution of the present invention has extremely excellent solution storage stability and is capable of realizing deposition at a low temperature, and accordingly, it has good workability and keeps working environment in good condition. Further, since the deposition rate is dependent on the palladium concentration and the solution temperature, control of the plating film thickness is easy. Moreover, since the plating film is substantially free from contamination with phosphorous, boron or the like, high-purity palladium having good catalytic activity can be obtained.

The plating film obtained by the plating solution of the present invention is extremely unlikely to have cracks and has excellent soldering properties and wire-bonding properties.

The plating solution of the present invention has the excellent properties as described above, and accordingly, it has great practical value as a plating material for various electronic parts which are required to have high reliability.

BEST MODE FOR CARRYING OUT THE INVENTION

In the following, the present invention will be described in further detail with reference to Examples.

EXAMPLE 1

| Composition of Plating Solution | |
|---|---|
| palladium chloride | 0.05 mol/liter |
| ethylenediamine | 0.03 mol/liter |
| malic acid | 0.05 mol/liter |
| citric acid | 0.05 mol/liter |
| sodium formate | 0.30 mol/liter |
| disodium hydrogenphosphate | 0.1 mol/liter |
| sodium sulfate | 0.1 mol/liter |
| sodium hydroxide | added to the above components so as to bring pH of the plating solution to 6.0 |

EXAMPLE 2

| Composition of Plating Solution | |
|---|---|
| palladium chloride | 0.05 mol/liter |
| ethylenediamine | 0.03 mol/liter |
| maleic acid | 0.05 mol/liter |
| citric acid | 0.05 mol/liter |
| sodium formate | 0.30 mol/liter |
| dipotassium hydrogenphosphate | 0.10 mol/liter |
| sodium sulfate | 0.10 mol/liter |
| potassium hydroxide | added to the above components so as to bring pH of the plating solution to 6.0 |

COMPARATIVE EXAMPLE 1

| Composition of Plating Solution | |
|---|---|
| palladium chloride | 0.05 mol/liter |
| ethylenediamine | 0.03 mol/liter |
| malic acid | 0.05 mol/liter |
| sodium formate | 0.30 mol/liter |
| sodium hydroxide | added to the above components so as to bring pH of the plating solution to 6.0 |

COMPARATIVE EXAMPLE 2

| Composition of Plating Solution | |
|---|---|
| palladium chloride | 0.05 mol/liter |
| ethylenediamine | 0.03 mol/liter |
| malic acid | 0.05 mol/liter |
| disodium hydrogenphosphate | 0.10 mol/liter |
| sodium formate | 0.30 mol/liter |
| sodium hydroxide | added to the above components so as to bring pH of the plating solution to 6.0 |

Each print circuit board having independent copper electrodes of ball grid array type and of 0.5 mm in diameter was subjected to customary pretreatment and then to plating by means of a commercially available electroless plating solution (phosphorus content: 8%) to form a nickel plating film having about 5 μm thereon. The print circuit boards were washed with running water for 1 minute and then subjected to plating, wherein a plating temperature was set to be 70° C. and a plating time was set to be 5 minutes, using the above-described electroless pure palladium plating solutions prepared in Examples and Comparative Examples, respectively.

Subsequently, thicknesses of the palladium films ware measured to examine plating rates and variations in film thickness. In this connection, the thicknesses of the plating films were measured with a fluorescent X-ray micro film thickness meter. The results are shown in Table 1.

TABLE 1

| | immediately after bath preparation* | after 5 days | after 10 days | after 15 days | after 20 days | after 25 days | after 30 days |
|---|---|---|---|---|---|---|---|
| Ex. 1 | 0.55 | 0.54 | 0.54 | 0.52 | 0.56 | 0.51 | 0.51 |
| | (0.12) | (0.15) | (0.14) | (0.11) | (0.16) | (0.15) | (0.13) |
| Ex. 2 | 0.55 | 0.54 | 0.52 | 0.52 | 0.52 | 0.51 | 0.51 |
| | (0.12) | (0.12) | (0.11) | (0.11) | (0.13) | (0.13) | (0.12) |
| Comp. Ex. 1 | 0.53 | 0.54 | 0.53 | 0.51 | 0.49 | 0.49 | 0.45 |
| | (0.23) | (0.26) | (0.25) | (0.27) | (0.30) | (0.30) | (0.33) |
| Comp. Ex. 2 | 0.55 | 0.53 | 0.51 | 0.53 | 0.51 | 0.50 | 0.49 |
| | (0.19) | (0.19) | (0.18) | (0.21) | (0.20) | (0.23) | (0.24) |

bath preparation*: plating bath preparation, i.e., initial make-up of plating bath In Table 1, the unit of the thicknesses is μm/5 min.

The numerical values are average values, and the numerical values in the parentheses are values of variations in film thickness.

As a result of the measurement of the deposition rates of the electroless pure palladium plating and thicknesses of the palladium films as described above, it was found that in Comparative Examples, the values of variations in film thickness increased as time elapsed after the plating bath preparation and reached 0.33 μm at the maximum. On the other hand, it was found that in Examples according to the present invention, even with lapse of time after the plating bath preparation, the deposition rates and the stabilities of the plating solutions were excellent, and the variations of the palladium plating films became about halves of those in Comparative Examples. Further, with respect to the finely interconnected substrates tested, evaluations on soldering properties and wire-bonding properties were carried out, and good results were obtained.

The invention claimed is

1. An electroless pure palladium plating solution comprising an aqueous solution comprising (a) 0.001 to 0.5 mol/liter of palladium chloride; and (b) 0.005 to 10 mol/liter of at least two members selected from the group consisting of aliphatic carboxylic acids and water-soluble salts thereof, wherein said at least two members comprises formic acid or formate and at least one selected from the group consisting of aliphatic (hydr)oxycarboxylic acid and aliphatic polycarboxylic acid; the aqueous solution further comprises (c) 0.005 to 10 mol/liter of phosphoric acid and/or a phosphate, (d) 0.005 to 10 mol/liter of sulfuric acid and/or a sulfate, and (e) ammonia and/or amine compound.

2. The electroless pure palladium plating solution according to claim 1, wherein the amine compound is ethylenediamine.

3. The electroless pure palladium plating solution according to claim 1, wherein the aliphatic (hydr)oxycarboxylic acid is malic acid, citric acid, tartaric acid, gluconic acid, glycolic acid, or lactic acid.

4. The electroless pure palladium plating solution according to claim 1, wherein aliphatic polycarboxylic acid is oxalic acid, malonic acid, maleic acid, succinic acid or glutaric acid.

* * * * *